US005547596A

United States Patent [19]

Omiya

[11] Patent Number: 5,547,596

[45] Date of Patent: Aug. 20, 1996

[54] LUBRICANT COMPOSITION FOR LIMITED SLIP DIFFERENTIAL OF CAR

[75] Inventor: Yasunori Omiya, Ichihara, Japan

[73] Assignee: Idemitsu Kosan Co., Ltd., Tokyo, Japan

[21] Appl. No.: 246,745

[22] Filed: May 20, 1994

[30] Foreign Application Priority Data

May 25, 1993 [JP] Japan ..... 5-122218

[51] Int. Cl.[6] ..... C10M 141/10

[52] U.S. Cl. ..... 508/188

[58] Field of Search ..... 252/49.9, 49.6

[56] References Cited

U.S. PATENT DOCUMENTS

| | | | |
|---|---|---|---|
| 3,901,932 | 8/1975 | Tada et al. . | |
| 4,118,328 | 10/1978 | Hotten | 252/49.9 |
| 4,472,288 | 9/1984 | Frost, Jr. | 252/49.9 |
| 4,599,191 | 7/1986 | Horodysky | 252/49.9 |
| 5,089,156 | 2/1992 | Chrisope et al. | 252/49.9 |

FOREIGN PATENT DOCUMENTS

| | | |
|---|---|---|
| 0430624 | 6/1991 | European Pat. Off. . |
| 0448207 | 9/1991 | European Pat. Off. . |
| 0459656 | 12/1991 | European Pat. Off. . |

OTHER PUBLICATIONS

Patent Abstracts of Japan, vol. 014, No. 188 (C–0710) 17 Apr. 1990.

*Primary Examiner*—Jacqueline V. Howard
*Attorney, Agent, or Firm*—Antonelli, Terry, Stout & Kraus

[57] ABSTRACT

A lubricant composition for LSD of a car is here disclosed which is obtained by adding a phosphate amine salt such as an amine salt of an oleyl acid phosphate and a borated ashless dispersant such as a reaction product of polybutenylsuccinimide and boric acid to a base oil, a ratio (N/P) of a nitrogen content (N) to a phosphorus content (P) being 0.5 or more, a ratio (N/B) of the nitrogen content (N) to a boron content (B) being 4 to 10. The lubricant composition of the present invention inhibits the generation of chattering during the operation of an LSD device, minimizes the friction on a metallic friction plate, and is excellent in oxidation stability.

10 Claims, No Drawings

LUBRICANT COMPOSITION FOR LIMITED SLIP DIFFERENTIAL OF CAR

BACKGROUND OF THE INVENTION

1. Field of the Invention

The present invention relates to a lubricant composition for a limited slip differential (LSD) of a car. More specifically, it relates to a lubricant composition for LSD which is excellent in oxidation stability and the prevention ability of the chattering (abnormal noise) of an LSD device incorporated in the differential of a car and which can be suitably applied to LSD of a studless tires-carrying car whose demand increases mainly in cold districts.

2. Description of the Prior Art

In general, as an LSD device incorporated in the differential of a car, a wet multiplate clutch is used, and its differential controlling force is maintained by the frictional force of a metallic plate. A lubricant for this LSD is required to have extreme-pressure properties of a GL-5 class, and thus the lubricants containing a sulfur-phosphorus additive and a friction modifier have been heretofore used.

However, these lubricants are poor in frictional properties, so that abnormal noise which is called chattering is generated during the operation of differential gears, or a metallic friction plate is abraded in a short period of time. In consequence, it is often difficult to maintain the initial performance of the differential gears for a long period of time.

Accordingly, it has been desired to develop a lubricating oil which is excellent in frictional properties and durability thereof and which minimizes the abrasion of a metallic friction plate.

SUMMARY OF THE INVENTION

Under such circumstances, we, the present inventors, have intensively researched with the intention of developing a lubricant for LSD which inhibits the generation of chattering during the operation of differential gears, minimizes the friction of a metallic friction plate, and is excellent in oxidation stability.

As a result, we have found that a lubricant composition having the desired characteristics can be obtained by adding a phosphate amine salt and a borated ashless dispersant to a base oil, and then adjusting a ratio between a nitrogen content and a phosphorus content and a ratio between a nitrogen content and a boron content. The present invention has been completed on the basis of such a knowledge.

That is, the present invention is directed to a lubricant composition for LSD of a car which is obtained by adding a phosphate amine salt and a borated ashless dispersant to a base oil comprising a mineral oil and/or a synthetic oil, a ratio (N/P) of a nitrogen content (N) to a phosphorus content (P) in the composition being 0.5 or more, and a ratio (N/B) of the nitrogen content (N) to a boron content (B) in the composition being 4 to 10.

DETAILED DESCRIPTION OF THE INVENTION

As the base oil for the lubricant composition of the present invention, there can be used conventional lubricating oils for LSD, various kinds of mineral oils and synthetic oils, and mixed oils thereof. No particular restriction is put on the kind and properties of base oil, but preferable are the mineral oils and/or the synthetic oils in which a kinematic viscosity at 100° C. is in the range of 1 to 50 cSt.

The suitable mineral oil and/or synthetic oil can be suitably selected in compliance with a use and the like from the various kinds of them. Preferable examples of the mineral oils include paraffinic mineral oils and naphthenic mineral oils, and suitable examples of the synthetic oils include polymers and copolymers of olefins, esters of dibasic acids, polyglycols and hindered esters.

Furthermore, the lubricant composition of the present invention can be obtained by blending the above-mentioned base oil with a phosphate amine salt and a borated ashless dispersant. Here, as the phosphate amine salt, various kinds of compounds are present, but preferable examples of the phosphate amine salt include amine salts of phosphates and amine salts of phosphites. Typical examples of the phosphate amine salt include amine salts of alkyl acid phosphates having an alkyl group of 10 to 20 carbon atoms (e.g., amine salts of oleyl acid phosphates and amine salts of lauryl acid phosphates), and amine salts of alkyl hydrogenphosphites.

On the other hand, as the borated ashless dispersant, various kinds of compounds can be used, but preferable examples of the borated ashless dispersant include reaction products (e.g., a reaction product of polybutenylsuccinimide and boric acid) of alkenylsuccinimides or alkenylsuccinamides having an alkenyl group of, preferably, 20 to 250 carbon atoms, more preferably 35 to 180 carbon atoms and boron compounds (e.g., boric acid and borates).

In the lubricant composition of the present invention, the amounts of the phosphate amine salt and the borated ashless dispersant are determined so that a ratio (N/P) of a nitrogen content (N) to a phosphorus content (P) in the composition may be 0.5 or more, preferably 0.7 to 1.0 and so that a ratio (N/B) of a nitrogen content (N) to a boron content (B) in the composition may be 4 to 10, preferably 6 to 9.

If the weight ratio of N/P is less than 0.5, the lubricant composition are poor in frictional properites, and chattering is liable to occur and the abrasion of a friction plate increases. Furthermore, if the weight ratio of N/B is more than 10, heat resistance deteriorates and sludge is liable to be generated. Conversely, the weight ratio of N/B is less than 4, the frictional properites deteriorate.

The amounts of the respective components in the lubricant composition of the present invention are determined so as to be in the above-mentioned ranges, but in addition to meeting the above-mentioned ranges, it is more preferable that the amount of the phosphate amine salt is in the range of 1 to 10% by weight, preferably 3 to 8% by weight based on the weight of the composition, and the amount of the borated ashless dispersant is in the range of 0.1 to 2% by weight, preferably 0.5 to 1.5% by weight based on the weight of the composition.

Moreover, the desired performance can be further effectively exerted by meeting these requirements and determining the amounts of the elements in the lubricant composition in the following ranges.

That is, more preferable results can be obtained by setting a sulfur content to 1.5–5.0% by weight, a phosphorus content to 0.15–0.40% by weight, a nitrogen content to 0.08–0.30% by weight and a boron content to 0.01–0.04% by weight, respectively.

The lubricant composition of the present invention comprises the above-mentioned essential components, but if necessary, various kinds of additives can be added to the lubricant composition. Examples of the additives include an extreme pressure agent (an olefin sulfide, sulfurized fats and oils or the like), an abrasion-resistant agent (a phosphate, a phosphite or the like), an antioxidant (phenol or the like), a defoaming agent (an organic silicone compound or the like), an ashless dispersant (succinimide or the like), a viscosity index improver (polymethacrylate or the like), a pour point depressant (polymethacrylate or the like) and a corrosion inhibitor (a sulfur compound, a nitrogen compound or the like).

When a lubricant composition of the present invention is applied to LSD of a car, the lubricant composition is excellent in frictional properties as the fresh oil and oxidation stability, chattering can be inhibited, change of frictional properties with the lapse of time is small, and abrasion on a metallic friction plate can also be minimized.

In consequence, the lubricant composition of the present invention can be considered to be very valuable as the lubricant for LSD of cars.

Next, the present invention will be described in more detail with reference to examples, but the scope of the present invention should not be limited by these examples at all.

EXAMPLES 1 AND 2, COMPARATIVE EXAMPLES 1 TO 3

For compositions obtained by blending components in ratios shown in Table 1, a low speed slide test, a low speed slide durability test, a Timken friction test, an ISOT test and a storage stability test were carried out. The results are shown in Table 1.

TABLE 1

| | | Example 1 | Example 2 |
|---|---|---|---|
| Composition | | | |
| Base oil (paraffinic mineral oil) 100° C., 17 cSt | | Balance | Balance |
| Phosphate amine salt*1 (wt %) | | 5.0 | 6.0 |
| Borated ashless dispersant*2 (wt %) | | 1.0 | 1.5 |
| Extreme pressure agent etc*3 (wt %) | | 7.2 | 7.2 |
| Elements | | | |
| Phosphorus content (wt %) | | 0.19 | 0.22 |
| Nitrogen content (wt %) | | 0.17 | 0.21 |
| Boron content (wt %) | | 0.020 | 0.030 |
| Nitrogen/phophorus (weight ratio) | | 0.89 | 0.95 |
| Nitrogen/boron (weight ratio) | | 8.5 | 7.0 |
| Test Results | | | |
| Low speed slide test*4 (μl/μ 50) | | | |
| Fresh oil | 40° C. | 0.83 | 0.87 |
| | 80° C. | 0.71 | 0.75 |
| ISOT used oil | 40° C. | 0.94 | 0.98 |
| (150° C. × 24 hr) | 80° C. | 0.92 | 0.91 |
| Low speed slide durability test (105° C. × 100 rpm × 48 hr) | | 4.9 | 4.7 |
| Abrasion loss of friction plate*5 (mg) | | | |
| Timken test*6 (LBS) | | 60 | 65 |
| ISOT (150° C. × 96 hr) | | | |
| Viscosity ratio (100° C.) | | 1.12 | 1.16 |
| Amount of insolubles*7 (wt %) | | 0.55 | 0.40 |
| Storage stability*8 (25° C. × 3 months) | | Good | Good |

TABLE 1-continued

| | | Comp. Ex. 1 | Comp. Ex. 2 | Comp. Ex. 3 |
|---|---|---|---|---|
| Composition | | | | |
| Base oil (paraffinic mineral oil) 100° C., 17 cSt | | Balance | Balance | Balance |
| Phosphate amine salt (wt %) | | 5.0*9 | 5.0*10 | 5.0*11 |
| Borated ashless dispersant*2 (wt %) | | 1.05 | 0.75 | 0.60 |
| Extreme pressure agent etc*3 (wt %) | | 7.2 | 7.2 | 7.2 |
| Elements | | | | |
| Phosphorus content (wt %) | | 0.22 | 0.26 | 0.35 |
| Nitrogen content (wt %) | | 0.10 | 0.18 | 0.14 |
| Boron content (wt %) | | 0.021 | 0.015 | 0.012 |
| Nitrogen/phophorus (weight ratio) | | 0.45 | 0.69 | 0.40 |
| Nitrogen/boron (weight ratio) | | 4.8 | 12.0 | 11.7 |
| Test Results | | | | |
| Low speed slide test*4 (μl/ μ 50) | | | | |
| Fresh oil | 40° C. | 0.93 | 0.90 | 0.95 |
| | 80° C. | 0.92 | 0.88 | 0.94 |
| ISOT used oil | 40° C. | 1.10 | 1.05 | 1.13 |
| (150° C. × 24 hr) | 80° C. | 1.13 | 1.06 | 1.17 |
| Low speed slide durability test (105° C. × 100 rpm × 48 hr) | | 14.5 | 9.8 | 15.7 |
| Abrasion loss of friction plate*5 (mg) | | | | |
| Timken test*6 (LBS) | | 50 | 50 | 55 |
| ISOT (150° C. × 96 hr) | | | | |
| Viscosity ratio (100° C.) | | 1.28 | 1.37 | 1.33 |
| Amount of insolubles*7 (wt %) | | 1.52 | 2.67 | 3.02 |
| Storage stability*8 (25° C. × 3 months) | | Precipitated | Good | Precipitated |

*1Phosphorus 3% by weight, nitrogen 3% by weight

*2Nitrogen = 2% by weight, boron = 2% by weight

*3An olefin sulfide, an acid phosphate or the like (sulfur = 22% by weight, phosphorus = 0.6% by weight)

*4With regard to details, refer to p. 353–356 of a manuscript for the 31st Spring Research Meeting (1987) of Japanese Lubricant Association. With regard to measurement conditions, an LSD friction plate (material = S35C with hardened surface, HRc = 49) was used as a driving plate; an LSD friction plate (material = S35C with hardened surface, HRc = 47) was used as a driven plate; surface pressure was 80 kg/cm$^2$; and rotational frequency was 1 to 100 rpm. μl means a coefficient of friction of 1 rpm, and K50 means a coefficient of friction of 50 rpm (if a value of μl/μ 50 is 1 or more, chattering occurs).

*5An abrasion loss of the friction plate is a weight difference between the total weights of the driving and driven plates before and after the test.

*6The test was made in accordance with ASTM-D2782.

*7The content of insolubles is the amount of n-pentane-insoluble substances. And it was made in accordance with a method of ASTM-D893.

*8100 ml of each sample was placed in a centrifugal tube, and its appearance was then observed.

*9Phosphorus = 3.5% by weight, nitrogen = 1.6% by weight.

*10Phosphorus = 4.3% by weight, nitrogen = 3.3% by weight.

*11Phosphorus = 6.1% by weight, nitrogen = 2.6% by weight.

What is claimed is:

1. A lubricant composition for a limited slip differential of a car which is obtained by adding a phosphate amine salt and a borated ashless dispersant to a base oil comprising at least one of a mineral oil and a synthetic oil, a ratio (N/P) of a nitrogen content (N) to a phosphorus content (P) in the composition being 0.5 to 1.0, and a ratio (N/B) of the nitrogen content (N) to a boron content (B) in the composition being 4 to 10; the phosphorus content being in the range of 0.15 to 0.40% by weight, the nitrogen content being in the range of 0.08 to 0.30% by weight, and the boron content being in the range of 0.01 to 0.04% by weight.

2. The lubricant composition according to claim 1 wherein said phosphate amine salt is an amine salt of an alkyl acid phosphate having an alkyl group of 10 to 20 carbon atoms, or an amine salt of an alkyl hydrogenphosphite.

3. The lubricant composition according to claim 2 wherein said phosphate amine salt is an amine salt of an oleyl acid phosphate or an amine salt of a lauryl acid phosphate.

4. The lubricant composition according to claim 1 wherein said borated ashless dispersant is a reaction product of an alkenylsuccinimide or an alkenylsuccinamide having an alkenyl group of 20 to 250 carbon atoms and a boron compound,

5. The lubricant composition according to claim 4 wherein said borated ashless dispersant is a reaction product of polybutenylsuccinimide and boric acid.

6. The lubricant composition according to claim 1 wherein the amount of said phosphate amine salt is in the range of 3 to 8% by weight based on the weight of the composition, and the amount of the borated ashless dispersant is in the range of 0.5 to 1.5% by weight based on the weight of the composition.

7. The lubricant composition according to claim 1 which further contains 1.5–5.0% by weight of sulfur.

8. A lubricant composition for a limited slip differential of a car which is obtained by adding a phosphate amine salt and a borated ashless dispersant to a base oil comprising at least one of a mineral oil and a synthetic oil, a ratio (N/P) of a nitrogen content (N) to a phosphorus content (P) in the composition being 0.5 to 1.0, a ratio (N/B) of the nitrogen content (N) to a boron content (B) in the composition being 4 to 10, an amount of a phosphate amine salt being in the range of 1 to 10% by weight based on the weight of the composition, and an amount of a borated ashless dispersant being in the range of 0.1 to 2% by weight based on the weight of the composition; the phosphorus content being in the range of 0.15 to 0.40% by weight, the nitrogen content being in the range of 0.08 to 0.30% by weight, and the boron content being in the range of 0.01 to 0.04% by weight.

9. A lubricant composition for a limited slip differential of a car which is obtained by adding a phosphate amine salt and a borated ashless dispersant to a base oil comprising at least one a mineral oil and a synthetic oil having a kinematic viscosity at 100° C. in the range of 1 to 50 cSt, a phosphorus content in the composition being in the range of 0.15 to 0.40% by weight, a nitrogen content in the composition being in the range of 0.08 to 0.30% by weight, a boron content in the composition being in the range of 0.01 to 0.04% by weight, a ratio (N/P) of the nitrogen content (N) to the phosphorus content (P) in the composition being 0.7 to 1.0, a ratio (N/B) of the nitrogen content (N) to the boron content (B) in the composition being 6 to 9, an amount of a phosphate amine salt being in the range of 1 to 10% by weight based on the weight of the composition, and an amount of a borated ashless dispersant being in the range of 0.1 to 2% by weight based on the weight of the composition.

10. The lubricant composition according to claim 9 wherein said mineral oil is a paraffinic mineral oil or a naphthenic mineral oil, and said synthetic oil is a polymer or a copolymer of olefins, an ester of a dibasic acid, a polyglycol or a hindered ester.

* * * * *